US007241022B2

(12) United States Patent
Lin

(10) Patent No.: US 7,241,022 B2
(45) Date of Patent: Jul. 10, 2007

(54) PEN WITH LIGHT SOURCE

(75) Inventor: Tse-Tsung Lin, Taipei (TW)

(73) Assignee: International Writing Instrument Corp., Taipei (TW)

( * ) Notice: Subject to any disclaimer, the term of this patent is extended or adjusted under 35 U.S.C. 154(b) by 114 days.

(21) Appl. No.: 11/154,884

(22) Filed: Jun. 15, 2005

(65) Prior Publication Data

US 2006/0285317 A1 Dec. 21, 2006

(51) Int. Cl.
*B43K 29/10* (2006.01)

(52) U.S. Cl. ..... 362/118

(58) Field of Classification Search ..... 362/118
See application file for complete search history.

(56) References Cited

U.S. PATENT DOCUMENTS 5,475,575 A * 12/1995 Chin-Hsiang ..... 362/203
6,129,473 A * 10/2000 Shu ..... 401/195

* cited by examiner

*Primary Examiner*—Thomas M. Sember
*Assistant Examiner*—Julie A Shallenberger
(74) *Attorney, Agent, or Firm*—Pro-Techtor Int'l Services

(57) ABSTRACT

A pen with light source comprises an upper case with a press-on turning device, an at least semi-transparent lower case, mounted on the upper case and containing a pen refill, and a lighting device, inserted inside the upper and lower cases, further comprising two end pins, two springs, a battery socket, batteries, a lamp socket, and a lamp, wherein the two end pins are electrically connected and disconnected by pressing on the press-on turning device, switching on and off the lamp, with above structural parts allowing for easy manufacturing and ensuring high luminosity.

8 Claims, 5 Drawing Sheets

PEN WITH LIGHT SOURCE

BACKGROUND OF THE INVENTION

1. Field of the Invention

The present invention relates to a pen, particularly to a pen with an integrated light source.

2. Description of Related Art

Stationery articles usually are made without integrated light sources. A pen with integrated light source is not only usable for writing, but also for illuminating, performing decorative functions, extending the range of application and enhancing fun of use.

China patent no. 02200769.5 "Pen with light source operated by pressing with soft coating" discloses a pen with an integrated light source, which is operated by thumb-pressing, and a soft coating. The pen has a pin in an eccentric position, an electric circuit and wires. A switch having two terminals controls switching on and off of light. Since the switch and a pen refill are mounted on a common axis, pressing down thereon will cause a ballpoint of the pen to project outward and simultaneously the light source to be switched on. The coating has protective as well as decorative functions. However, there are still structural parts that are required for improvement, like connecting wires, a conductive ring, a casing, a thread, the eccentric pin, a spring, end pins, and another spring. Terminals of a battery have too complicated structures, therefore are too expensive to manufacture and are prone to defects, so that the lifetime of the pen is limited. Furthermore, a case with a metal section is used, in which a lighting element is placed, so that luminosity is reduced.

SUMMARY OF THE INVENTION

The object of the present invention is to provide a pen with a light source which is easier to manufacture and has improved luminosity.

The present invention is a pen with light source comprising an upper case with a press-on turning device, an at least semi-transparent lower case, mounted on the upper case and containing a pen refill, and a lighting device, inserted inside the upper and lower cases. The lighting device further comprises two end pins, two springs, a battery socket, batteries, a lamp socket, and a lamp. The battery socket has an upper side with one half passed through by two holes, in which the end pins, passing through the springs, are respectively inserted, with a conducting plate eccentrically attached to a lower side of a lower gear of the press-on turning device and contacting the end pins according to an angular position of the conducting plate. The batteries include several coin cells inserted in the battery case and separated therefrom by an insulating sleeve. The battery socket is fastened to an upper end of the battery case, forming an integrated body therewith The lamp has two connecting feet one of which is connected, via the battery case and a conducting tubelet reaching through a cut in the battery socket, with one of the end pins and the other with one terminal of the batteries. Thereby, pressing on the press-on turning device switches on and off the lamp. Above structural parts simplify electrical conducting paths, allow for easy manufacturing and ensure high luminosity and a decorative effect due to insulating, semi-transparent material of the lower cap.

The present invention can be more fully understood by reference to the following description and accompanying drawings.

DETAILED DESCRIPTION OF THE PREFERRED EMBODIMENTS

As shown in FIGS. 1-3, the pen with a light source of the present invention comprises: an upper casing 1; a lower casing 2 which is at least semi-transparent, connected with the upper casing 1; a lighting device 3 inserted in the lower casing 2; and a press-on turning device 4 inserted in the upper casing 1. The press-on turning device 4 is conventional art, comprising a pressuring knob, a spring, an upper gear, a lower gear, a toothed ring, and a groove. The press-on turning device 4 serves solely to transform linear pressure on the knob into a turning movement, being a structural part in a conventional ballpoint pen, and therefore is not further explained. A pen refill is inserted into the lower casing 2. Since the lower casing 2 is transparent or semi-transparent, light generated by the light source 2 is emitted unhindered.

The lighting device 3 comprises two end pins 7, two springs 8, two conducting tubelets 9, a battery socket 6, a battery case 14, three batteries 10, an insulating sleeve 11, a lamp socket 12, and a light emitting diode (LED) 13, together forming an independent structural part. The battery case 14 is metallic, housing the batteries 10 which are coin cells. The insulating sleeve II inserted between the batteries 10 and the battery case 14. The battery socket 6 has an upper side with two through holes, which are located in a semi-circular area, in which the end pins 7, passing through the springs 8, are inserted, connecting to the conducting tubelets 9, so that improved conductivity is achieved. The lower gear of the press-on turning device 4 has a lower side with a depression, in which a semicircular conducting plate 5 is eccentrically set. On turning the conducting plate 5 the two end pins 7 are electrically connected and disconnected. Connecting feet fix the LED 13 in lateral fixing grooves in the lamp socket 12, contacting a terminal of the battery 10 and the battery case 14, respectively. The end pins 7 are led through the springs 8 and are connected with the conducting tubelets 9. One of the conducting tubelets 9 contacts the battery case 14 through a lateral cut in the battery socket 6, so that one of the connecting feet of the LED 13 is connected with one of the end pins 7. The other of the end pins 7 is connected to the batteries 10 so that by turning the conducting plate 5 the LED 13 is switched on and off.

Having mounted the upper case 1 on the lower case 2, the lighting device 3 is inserted in between, providing for a lighting function of the pen of the present invention.

Referring to FIGS. 6 and 7, the present invention in another embodiment has upper and lower cases 1, 2 of square cross-sections.

For using the present invention, a knob on the upper case 1 is pressed. Thereupon the press-on turning device 4 causes the conducting plate 5 to turn by 90 degrees. As shown in FIG. 4, after having pressed the knob on the upper case 1, an original state is assumed again. Thus switching on and off of the LED 13 is allowed.

Figure 1:
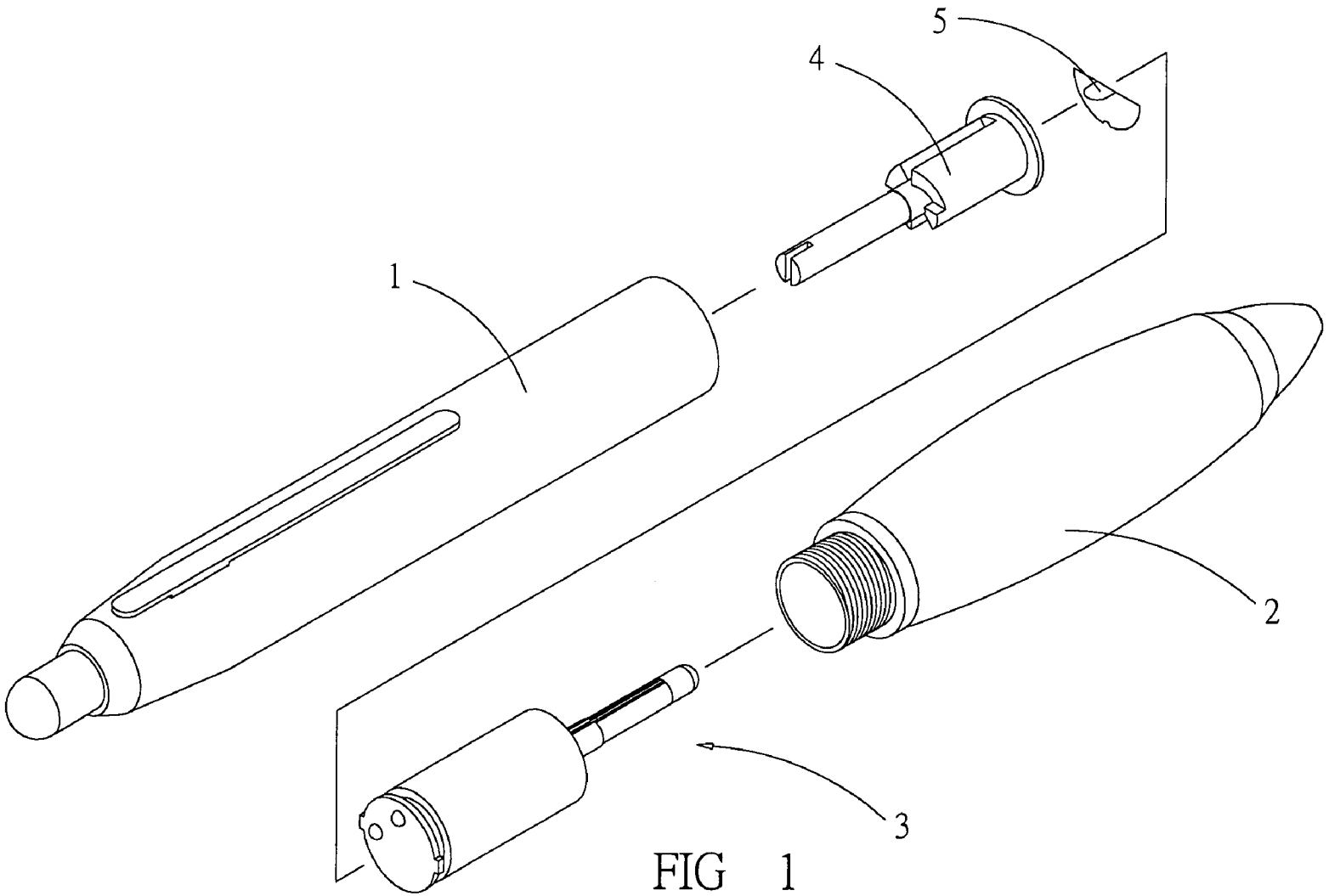
FIG. 1 is an exploded perspective view of the pen with a light source of the present invention.
Figure 2:
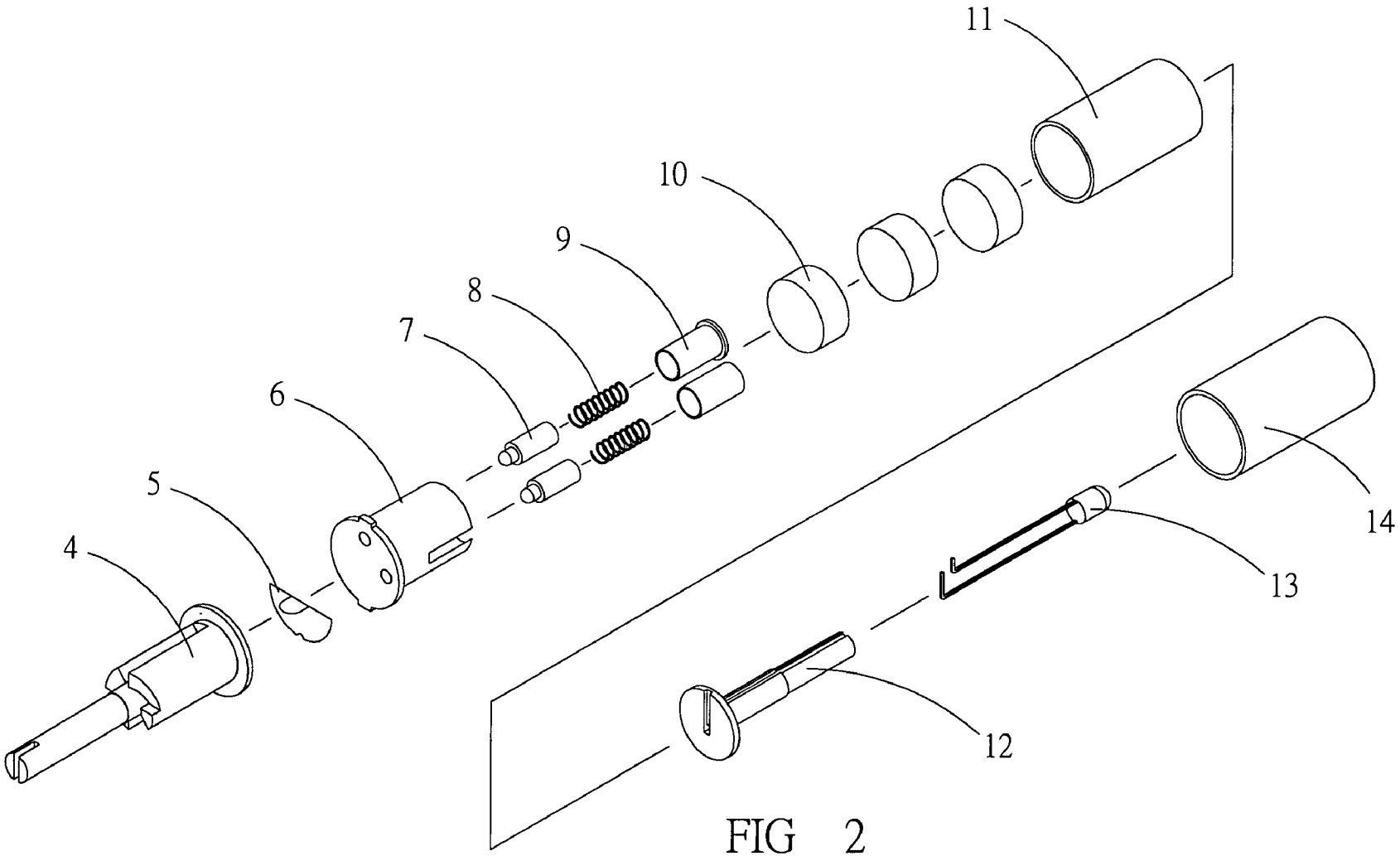
FIG. 2 is an exploded perspective view of the press-on turning device and the lighting device of the present invention.
Figure 3:
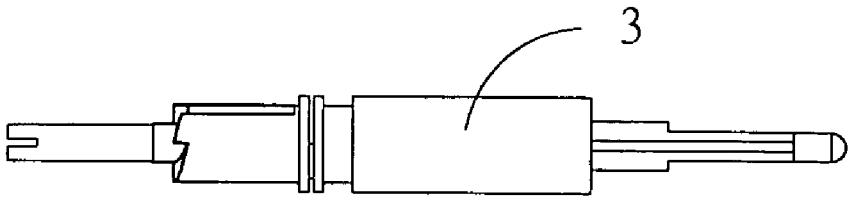
FIG. 3 is a side view of the light source of the present invention.
Figure 4:
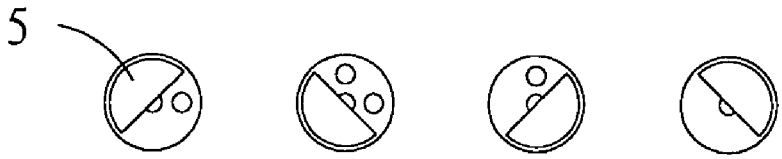
FIG. 4 is a schematic illustration of turning the conductor plate side of the present invention.
Figure 5:
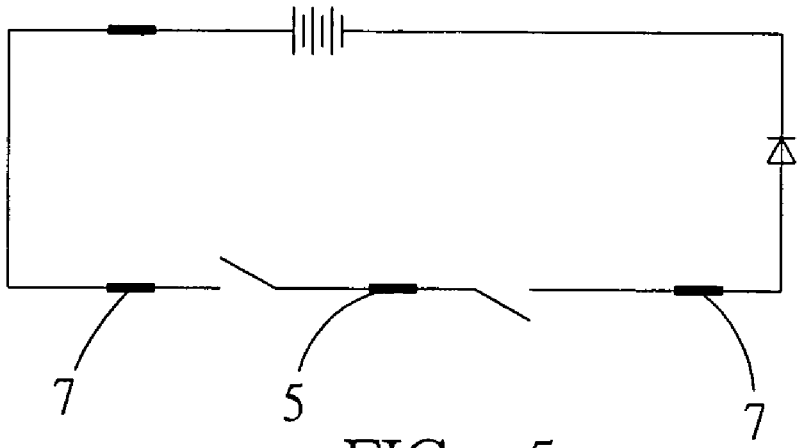
FIG. 5 is a schematic illustration of the electric circuit of the present invention.
Figure 6:
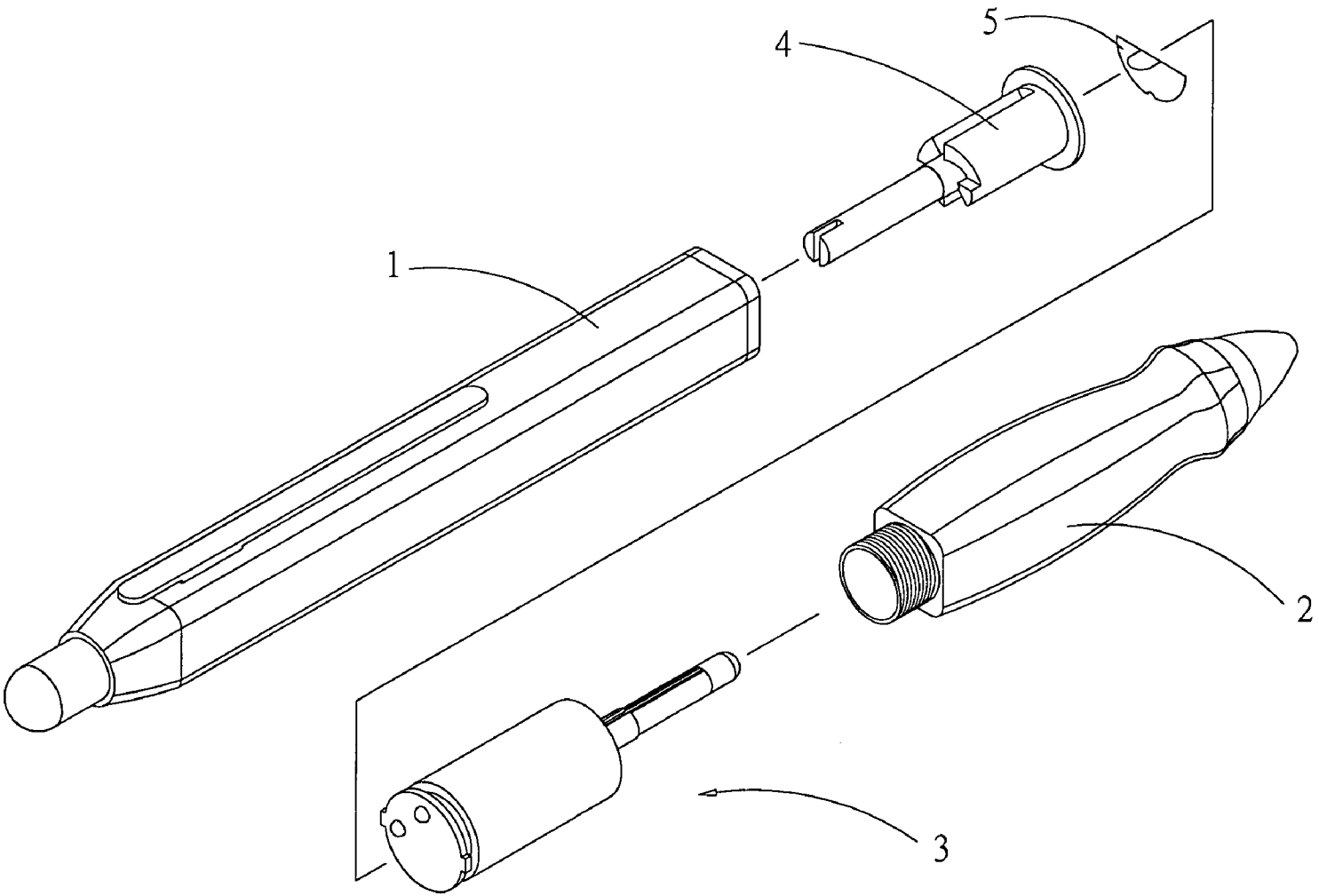
FIG. 6 is an exploded perspective view of the pen with a light source of the present invention in another embodiment.
Figure 7:
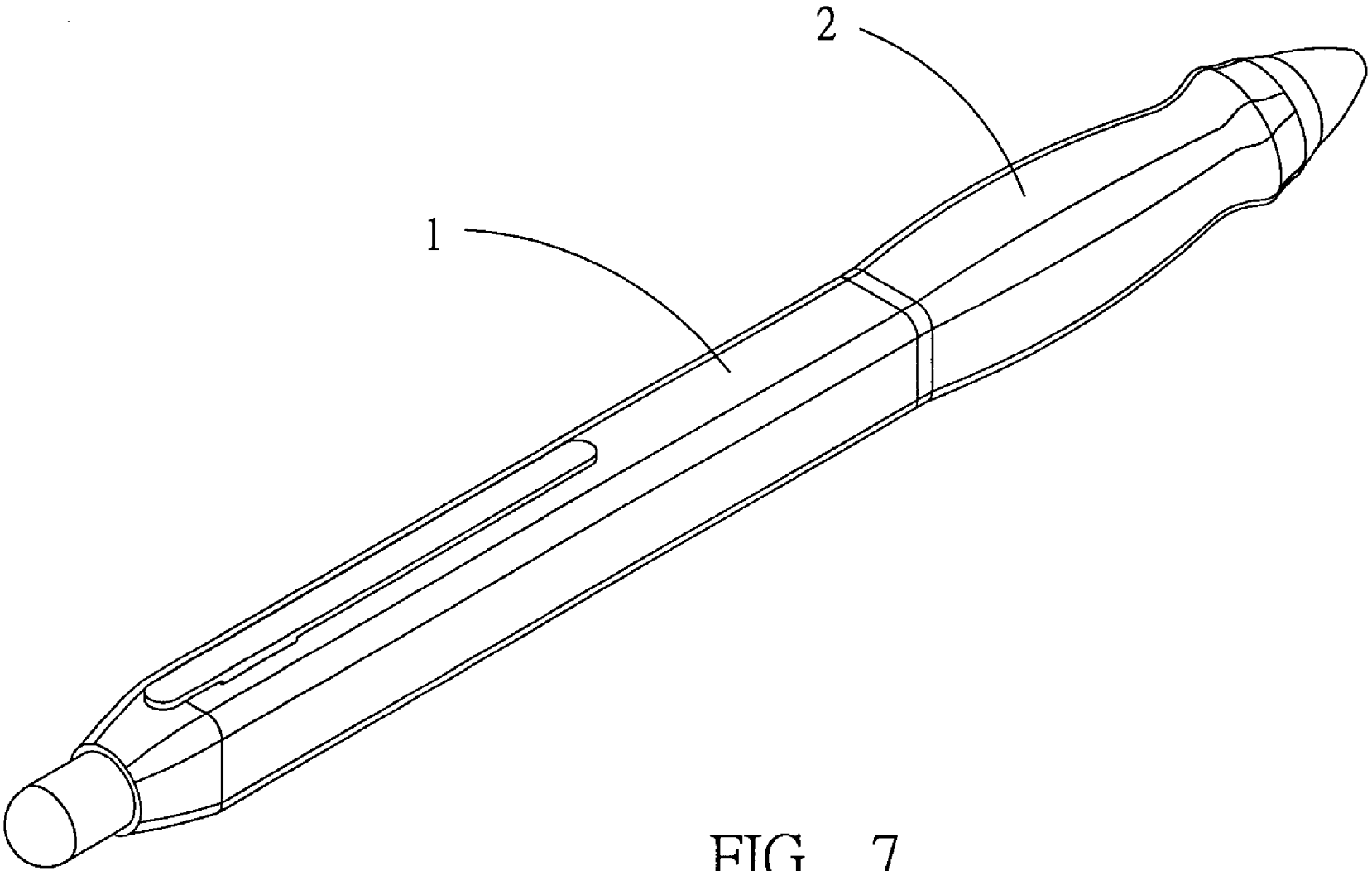
FIG. 7 is a perspective view of the pen with a light source of the present invention in another embodiment.

The invention claimed is:

1. A pen with a light source, comprising:

an upper case, in which a press-on turning device is inserted;

a lower case, being at least semi-transparent, mounted on said upper case and containing a pen refill; and a lighting device, inserted inside said upper and lower cases, further comprising two end pins, two springs, a battery socket, batteries, a lamp socket, and a lamp, wherein said battery socket has an upper side with two through holes, in which said end pins, passing through said springs, are respectively inserted, with a conducting plate eccentrically attached to a lower side of a lower gear of said press-on turning device and contacting said end pins according to an angular position of said conducting plate, and wherein said lamp has two connecting feet, one connecting to one of said end pins and one connecting to one terminal of said batteries.

2. The pen with light source according to claim 1, further comprising a battery case made of metal housing said batteries and being separated therefrom by an insulating sleeve, with said battery socket fastened on said battery case on an upper end thereof.

3. The pen with light source according to claim 2, wherein each of said two end pins connects to a conducting tubelet, one of which reaches through a cut in said battery socket, contacting said battery case.

4. The pen with light source according to claim 3, wherein said connecting feet of said lamp are fixed in two lateral grooves of said lamp socket.

5. The pen with light source according to claim 4, wherein said two end pins, said two springs, said conducting tubelets, said battery case, said battery socket, said batteries, said insulating sleeve, said lamp socket, and said lamp form an independent structural part.

6. The pen with light source according to claim 5, wherein said lamp is a light emitting diode.

7. The pen with light source according to claim 6, wherein said conducting plate is shaped like a semicircle.

8. The pen with light source according to claim 7, wherein said lower gear on said lower side thereof has a depression for accommodating said conducting plate.

* * * * *